US009123994B2

(12) United States Patent
Lee et al.

(10) Patent No.: US 9,123,994 B2
(45) Date of Patent: Sep. 1, 2015

(54) ANTENNA STRUCTURE

(75) Inventors: Young-ju Lee, Seoul (KR); Byung-chul Kim, Hwaseong-si (KR); Jung-min Park, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 543 days.

(21) Appl. No.: 13/482,453

(22) Filed: May 29, 2012

(65) Prior Publication Data

US 2012/0299783 A1 Nov. 29, 2012

Related U.S. Application Data

(60) Provisional application No. 61/490,715, filed on May 27, 2011.

(30) Foreign Application Priority Data

Oct. 31, 2011 (KR) ..... 10-2011-0112501

(51) Int. Cl.

| | |
|---|---|
| ***H01Q 1/36*** | (2006.01) |
| ***H01Q 1/22*** | (2006.01) |
| ***H01Q 1/24*** | (2006.01) |
| ***H01Q 1/38*** | (2006.01) |
| ***H01Q 1/52*** | (2006.01) |
| ***H01Q 9/04*** | (2006.01) |

(52) U.S. Cl.

CPC ..... *H01Q 1/36* (2013.01); *H01Q 1/2291* (2013.01); *H01Q 1/243* (2013.01); *H01Q 1/38* (2013.01); *H01Q 1/52* (2013.01); *H01Q 9/0414* (2013.01)

(58) Field of Classification Search

CPC ..... H01Q 1/38; H01Q 1/243; H01Q 9/0414
USPC ..... 343/702, 700 MS
See application file for complete search history.

(56) References Cited

U.S. PATENT DOCUMENTS

| | | | | |
|---|---|---|---|---|
| 5,986,606 | A * | 11/1999 | Kossiavas et al. | 343/700 MS |
| 6,822,609 | B2 * | 11/2004 | Mendolia et al. | 343/700 MS |
| 7,764,236 | B2 * | 7/2010 | Hill et al. | 343/702 |
| 8,051,550 | B2 | 11/2011 | Cheng et al. | |
| 2002/0180649 | A1 | 12/2002 | Iguchi et al. | |

(Continued)

FOREIGN PATENT DOCUMENTS

| | | | |
|---|---|---|---|
| CN | 101192698 | A | 6/2008 |
| CN | 101232122 | A | 7/2008 |

(Continued)

OTHER PUBLICATIONS

Communication dated Jul. 24, 2012, issued by the European Patent Office in counterpart European Application No. 12161329.3.

(Continued)

*Primary Examiner* — Dameon E Levi
*Assistant Examiner* — Hasan Islam
(74) *Attorney, Agent, or Firm* — Sughrue Mion, PLLC

(57) ABSTRACT

An antenna structure includes: a substrate; a ground layer disposed on a first surface of the substrate; a patch antenna unit which is disposed on a second surface of the substrate opposite to the first surface of the substrate, and is configured to receive a signal to be radiated; and a three-dimensional (3D) antenna unit which comprises a shorting leg that is shorted with the patch antenna unit, and is configured to radiate the signal received by the patch antenna unit.

21 Claims, 7 Drawing Sheets

(56) References Cited

U.S. PATENT DOCUMENTS

| | | | | |
|---|---|---|---|---|
| 2008/0158069 | A1* | 7/2008 | Mateus Mendes et al. | 343/700 MS |
| 2008/0174496 | A1* | 7/2008 | Hsu et al. | 343/700 MS |
| 2008/0252530 | A1 | 10/2008 | Bae et al. | |
| 2011/0032154 | A1* | 2/2011 | Chung et al. | 343/700 MS |
| 2011/0043413 | A1* | 2/2011 | Zadesky et al. | 343/702 |
| 2011/0080323 | A1* | 4/2011 | Thiam et al. | 343/700 MS |

FOREIGN PATENT DOCUMENTS

| | | | |
|---|---|---|---|
| JP | 61-41205 | A | 2/1986 |
| JP | 669122 | B2 | 2/1986 |
| KR | 10-2006-0007590 | A | 1/2006 |
| KR | 10-2008-0105398 | A | 12/2008 |
| KR | 10-2009-0008550 | A | 1/2009 |
| KR | 10-2009-0131429 | A | 12/2009 |

OTHER PUBLICATIONS

Communication dated Dec. 10, 2012 issued by the International Searching Authority in counterpart International Application No. PCT/KR2012/004041.

Communication dated Oct. 7, 2014 issued by the Mexican Patent Office in counterpart Mexican Patent Application No. MX/a/2013/013925.

Communication issued on May 19, 2015 by The State Intellectual Property Office of PR China in related Application No. 201210167787.1.

* cited by examiner

ANTENNA STRUCTURE

CROSS-REFERENCE TO RELATED PATENT APPLICATION

This application claims priority from U.S. Provisional Application No. 61/490,715, filed on May 27, 2011 in the United States Patent and Trademark Office, and Korean Patent Application No. 10-2011-0112501, filed on Oct. 31, 2011 in the Korean Intellectual Property Office, the disclosures of which are incorporated herein in their entireties by reference.

BACKGROUND

1. Field

Apparatuses and methods consistent with exemplary embodiments relate to a small antenna for wireless communication.

2. Description of the Related Art

Various wireless fidelity (WiFi) systems that use a WiFi network that is a near field communication (NFC) network using electric waves or an infrared ray transmission method are widely used in network elements sharing information including multimedia.

For example, digital photographing apparatuses, such as digital cameras, camcorders, mobile phones having a photographing function, and the like, typically have an additional wireless communication function and may be networked with other electronic devices, such as televisions (TVs), computers, printers, and the like. An image that is captured by a digital photographing apparatus is transmitted and received wirelessly, and various pieces of information, as well as an image, may be transmitted and received.

In order to perform such wireless communication, antennas are generally installed in an electronic device. However, as the size of electronic devices decreases, and in order for electronic devices to perform more functions, a large number of components are provided in the electronic devices. Thus, the space for installing an antenna in the electronic device is diminished, such that a smaller antenna structure is required. However, the radiation performance of a smaller antenna may be lowered due to the effect of a metal structure being disposed within close proximity to the antenna in the electronic device. Accordingly, a design for preventing this problem is needed.

SUMMARY

Exemplary embodiments provide a small antenna with a reduced effect of a metal structure that is disposed adjacent to the antenna.

According to an aspect of an exemplary embodiment, there is provided an antenna structure including: a substrate; a ground layer disposed on a first surface of the substrate; a patch antenna unit which is disposed on a second surface of the substrate opposite to the first surface of the substrate, and is configured to receive a signal to be radiated; and a three-dimensional (3D) antenna unit which comprises a shorting leg that is shorted with the patch antenna unit, and is configured to radiate the signal received by the patch antenna unit.

The 3D antenna unit may further include: a planar pattern unit spaced apart from the patch antenna unit by a predetermined distance, wherein the shorting leg extends from the planar pattern unit towards the patch antenna unit.

Slit patterns for frequency tuning may be formed in the planar pattern unit.

The slit patterns may have a groove shape that is recessed from a lateral portion of the planar pattern unit.

The slit patterns may have an opening shape that is formed through the planar pattern unit.

The shorting leg may include: a protrusion that protrudes from the 3D antenna unit by a length corresponding to the predetermined distance; and a bonding portion that is curved and extends from the protrusion in a direction parallel to a top surface of the patch antenna unit.

The 3D antenna unit may include at least one floating leg that extends from the planar pattern unit to the patch antenna unit.

The at least one floating leg may be configured to support the planar pattern unit and the shorting leg.

The at least one floating leg may include a first floating leg and a second floating leg that are respectively disposed at sides of the shorting leg between the first and second floating legs.

The first floating leg and the second floating leg may be fixed on the substrate.

Ends of the first floating leg and the second floating leg may be bent in a direction parallel to the a plane of the substrate that faces the ground layer.

A first bonding pad and a second bonding pad may be formed on the substrate so that the first floating leg and the second floating leg are bonded to the substrate, respectively.

A dielectric carrier may be disposed between the planar pattern unit and the patch antenna unit.

The shorting leg may extend from a top surface of the dielectric carrier to a bottom surface of the dielectric carrier along a side surface of the dielectric carrier.

The 3D antenna unit may include at least one floating leg that extends from an end of the planar pattern unit along the side surface of the dielectric carrier to the patch antenna unit.

The signal to be radiated may be supplied to the patch antenna unit by one of a coupling feeding, a line feeding and a coaxial feeding.

Slit patterns for frequency tuning may be formed in the patch antenna unit.

The slit patterns may have a groove shape that is recessed from a lateral portion of the planar pattern unit or an opening shape that is formed through the planar pattern unit.

The substrate may be formed of a FR4 material.

A radio frequency (RF) circuit and a transmission line, via which a signal generated by the RF circuit may be transmitted to the patch antenna unit, may be embedded in the substrate.

According to an aspect of another exemplary embodiment, there is provided an electronic device having a wireless communication function, the electronic device including an antenna structure including a substrate; a ground layer disposed on a bottom surface of the substrate; a patch antenna unit, which is disposed on a top surface of the substrate, and to which a signal to be radiated is supplied; and a 3D antenna unit, which comprises a shorting leg that is shorted with the patch antenna unit, and which radiates the signal supplied to the patch antenna unit.

The electronic device may include a metal structure, and the ground layer of the antenna structure is bonded to the metal structure.

According to an aspect of another exemplary embodiment, there is provided an antenna structure that transmits a signal generated by a radio frequency (RF) circuit, the antenna structure including: a printed circuit board (PCB) substrate comprising a ground and a transmission line via which the signal generated by the RF circuit is transmitted; a ground layer, which is disposed on a bottom surface of the substrate and is shorted with the substrate; a patch antenna unit, which is disposed on a top surface of the PCB substrate, wherein the signal generated by the RF circuit is transmitted to the patch antenna unit via the transmission line in the PCB substrate; and a three-dimensional (3D) antenna unit, which comprises a shorting leg that is shorted with the patch antenna unit, and which radiates the signal transmitted to the patch antenna unit via the transmission line.

The antenna structure may further include the RF circuit, wherein the RF circuit is embedded in the PCB substrate.

BRIEF DESCRIPTION OF THE DRAWINGS

The above and/or other aspects will become more apparent by describing in detail exemplary embodiments with reference to the attached drawings in which.

DETAILED DESCRIPTION

Figure 1:
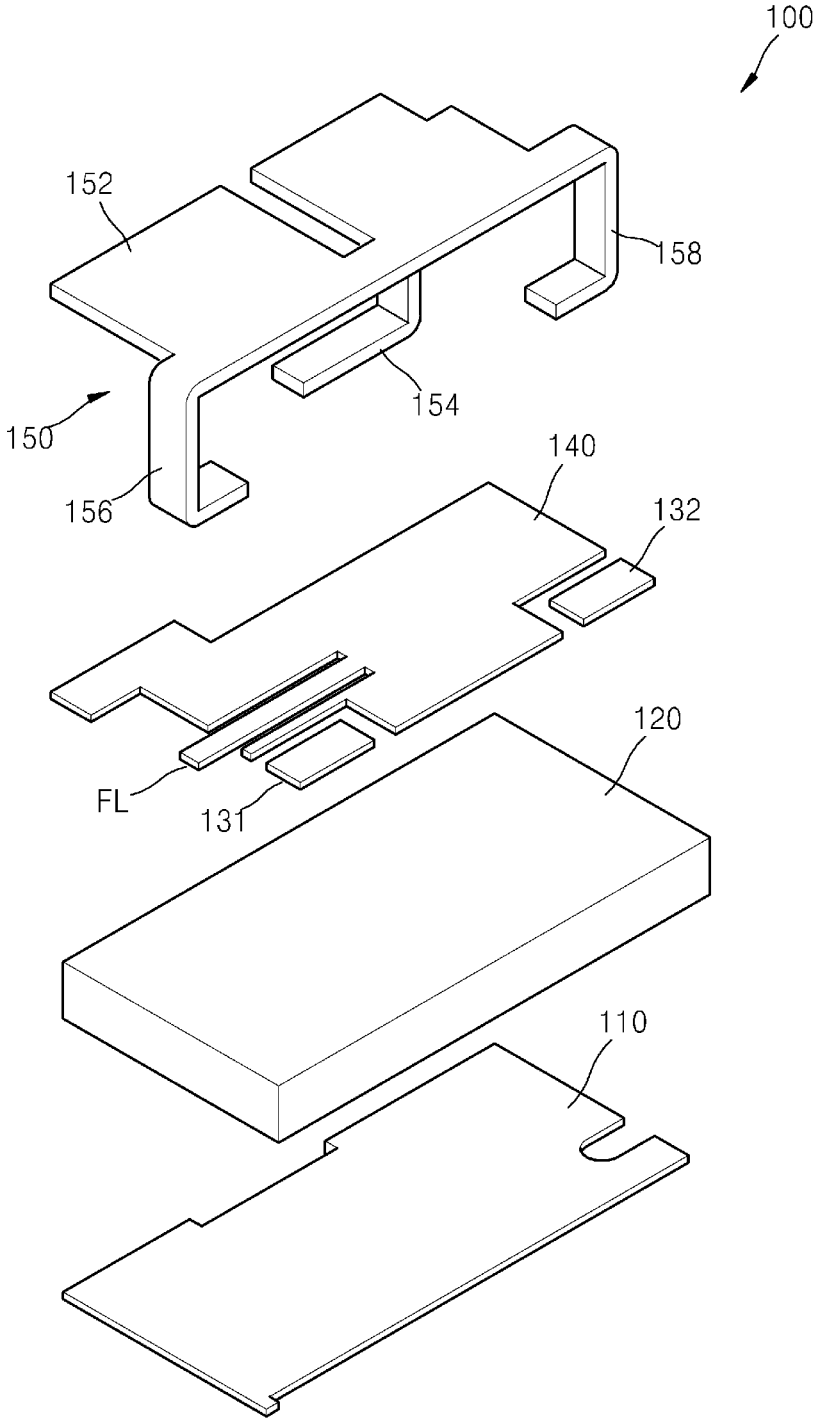
FIG. 1 is a schematic exploded perspective view of a configuration of an antenna structure according to an exemplary embodiment.

Exemplary embodiments will now be described more fully with reference to the accompanying drawings. Like reference numerals in the drawings denote like elements, and the sizes of elements in the drawings may be exaggerated for clarity and convenience.

Most of the terms used herein are general terms that have been widely used in the technical art to which the present inventive concept pertains. However, some of the terms used herein may be created reflecting intentions of technicians in this art, precedents, or new technologies. Also, some of the terms used herein may be arbitrarily chosen. In this case, these terms are defined in detail below. Accordingly, the specific terms used herein should be understood based on the unique meanings thereof and the whole context of the disclosure as set forth herein.

In the present specification, it should be understood that the terms, such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added. Also, the terms, such as "portion" "piece," "section," "part," etc., should be understood as a part of a whole; an amount, section or piece. Further, as used herein, the term "and/or" includes any and all combinations of one or more of the associated listed items. Expressions such as "at least one of," when preceding a list of elements, modify the entire list of elements and do not modify the individual elements of the list.

Figure 2:
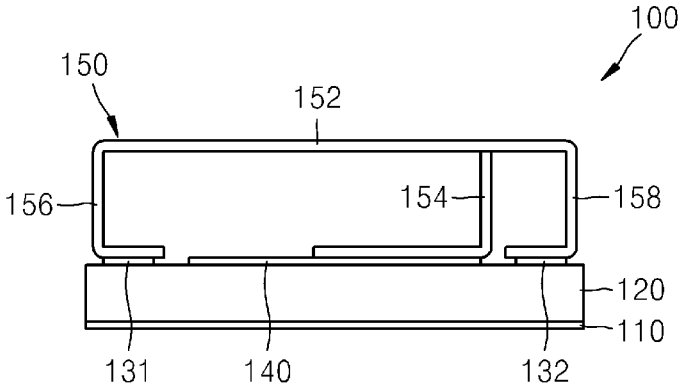
FIG. 2 is a side view of an antenna structure, an example of which is illustrated in FIG. 1.

FIG. 1 is a schematic exploded perspective view of a configuration of an antenna structure 100 according to an exemplary embodiment, and FIG. 2 is a side view of the antenna structure 100 illustrated in FIG. 1.

Referring to FIGS. 1 and 2, the antenna structure 100 includes a substrate 120, a ground layer 110 that is formed on a bottom surface of the substrate 120, a patch antenna unit 140 which is formed on a top surface of the substrate 120 and to which a signal to be radiated is supplied, a shorting leg 154 that is shorted with the patch antenna unit 140, and a three-dimensional (3D) antenna unit 150 having a radiation unit for radiating a signal from the patch antenna unit 140.

The configuration of the antenna structure 100 according to the current exemplary embodiment may improve radiation efficiency while reducing the size of the antenna structure 100. When radiation of the antenna structure 100 occurs in a random direction, the performance of the antenna structure 100 may deteriorate due to a metal structure that may be disposed adjacent to the antenna structure 100. For example, when the antenna structure 100 is disposed inside a camera, the antenna structure 100 may be adjacent to a metal plate, such as a capacitor. In addition, since most electronic devices that have a wireless communication function include a structure that is formed of metal, such as a frame, a case, a panel, or the like, when the antenna structure 100 is disposed inside a device, the antenna structure 100 is adjacent to the metal material, and the radiation performance of the antenna structure 100 deteriorates. However, there is a difference in radiation efficiency of a chip antenna that is designed in a 2.4 GHz band of 60% or more and 25%, respectively, when the antenna structure 100 is in a wireless fidelity (WiFi) board state and when the antenna structure 100 is installed on the camera. In order to reduce the difference, the inventor suggests a structure in which radiation of the antenna structure 100 occurs less at a predetermined position and the predetermined position being adjacent to the metal material so that radiation efficiency of the antenna structure 100 that is disposed outside the device may be improved.

A more detailed configuration and operation of the antenna structure 100 will now be described.

Insulating substrates formed of various materials may be used as the substrate 120. The substrate 120 may be formed of a FR4 material, for example.

The patch antenna unit 140 and the ground layer 110 that are formed on the top and bottom surfaces of the substrate 120, respectively, serve to make a resonant mode inside two metals and to combine with resonance that occurs due to the 3D antenna unit 150. In this regard, the ground layer 110 serves to reduce the effect of any metal that may be disposed adjacent to the antenna structure 100. Generally, when the antenna structure 100 is used, a printed circuit board (PCB) substrate including a radio frequency (RF) circuit for generating a signal to be radiated by the antenna structure 100 may be provided, and the ground layer 110 may be shorted with a ground of the PCB substrate. In the current embodiment, such RF circuit may be embedded in the substrate 120, and a transmission line via which a signal generated by the RF circuit is transmitted to the patch antenna unit 140 may be embedded in the substrate 120 together with the RF circuit.

The patch antenna unit 140 includes a feeding line FL to which a signal to be radiated is supplied. In addition, slit patterns for frequency tuning may be formed on the patch antenna unit 140. Although two slit patterns are formed in the patch antenna unit 140, as shown in exemplary embodiments of FIGS. 1 and 2, this is just an example. One or more slit patterns may be formed in the patch antenna unit 140, or no slit patterns may be formed in the patch antenna unit 140. In addition, the shape of the slit patterns is a groove shape that is recessed from a lateral portion of the patch antenna unit 140. However, other exemplary embodiments are not limited thereto, and the slit patterns may have an opening shape, for example. A detailed shape of the patch antenna unit 140 including the feeding line FL is not limited to the shape of FIGS. 1 and 2 and may be modified in various ways according to the frequency of a signal or a feeding method, which will be described below.

The 3D antenna unit 150 includes the shorting leg 154 that is shorted with the patch antenna unit 140 and the radiation unit that radiates a signal from the path antenna unit 140. The 3D antenna unit 150 is used to make a resonance mode in a frequency band of a signal to be radiated together with the patch antenna unit 140. The 3D antenna unit 150 serves to extend a length of the patch antenna unit 140. As the 3D antenna unit 150 is introduced, the size of the patch antenna unit 140 may be reduced. For example, when a 2.4 GHz band design is used with only the patch antenna unit 140, the size of the patch antenna unit 140 is approximately 30×30 $mm^2$. However, when the 3D antenna unit 150 as well as the patch antenna unit 140 is used to design a 2.4 GHz band device, the size of the patch antenna unit 140 is reduced to approximately 7.5×4 $mm^2$.

In more detail, the 3D antenna unit 150 includes a planar pattern unit 152 that is spaced apart from the patch antenna unit 140 by a predetermined distance. The shorting leg 154 and the radiation unit of the 3D antenna unit 150 extend from the planar pattern unit 152 towards the patch antenna unit 140.

A detailed shape of the planar pattern unit 152 is properly designed according to the frequency of a signal to be radiated and is not limited to the shape shown in the exemplary embodiments of FIGS. 1 and 2. The slit patterns for frequency tuning may be formed in the planar pattern unit 152. Although one slit pattern is formed in the planar pattern unit 152, as illustrated in FIG. 2, this is just an example, and a plurality of slit patterns may be formed in the planar pattern unit 152, or no slit patterns may be formed on the planar pattern unit 152. In addition, the shape of the slit pattern is a groove shape that is recessed from a lateral portion of the planar pattern unit 152. However, other exemplary embodiments are not limited thereto, and slit patterns having an opening shape, for example, may be formed in the planar pattern unit 152.

The shorting leg 154 includes a protrusion that protrudes from the 3D antenna unit 150 by a length corresponding to a separation distance between the planar pattern unit 152 and the patch antenna unit 140, and a bonding portion that is curved from the protrusion and extends in a direction parallel to a top surface of the patch antenna unit 140. The bonding portion of the shorting leg 154 is shorted with the patch antenna unit 140.

The radiation unit may include at least one floating leg that extends from one end of the planar pattern unit 152 towards the patch antenna unit 140. At least one floating leg may be configured to support the planar pattern unit 152 together with the shorting leg 154. The radiation unit may include a first floating leg 156 and a second floating leg 158, as illustrated in FIG. 2. The first floating leg 156 and the second floating leg 158 may be disposed at both sides of the shorting leg 154 therebetween. However, the first floating leg 156 and the second floating leg 158 are not limited to the number, the position, and the shape illustrated in FIG. 2.

The first floating leg 156 and the second floating leg 158 may be fixed on the substrate 120 to support the planar pattern unit 152. To this end, ends of the first floating leg 156 and the second floating leg 158 may be bent in a direction parallel to the substrate 120. In addition, a first bonding pad 131 and a second bonding pad 132 may be further formed on the substrate 120 so that the first floating leg 156 and the second floating leg 158 are bonded to the substrate 120, respectively.

FIGS. 3A through 3G illustrate examples of a feeding structure that is employed in the patch antenna unit 140 of the antenna structure 100 illustrated in FIG. 1.

Line feeding, coupling feeding, or coaxial feeding may be used as a feeding method of the patch antenna unit 140.

Figure 3A:
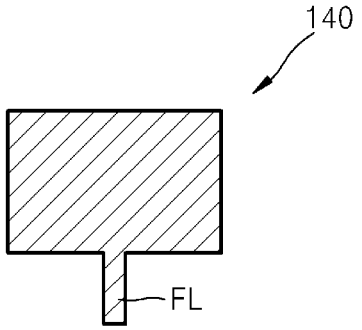
FIGS. 3A through 3G illustrate examples of a feeding structure that is employed in a patch antenna unit of an antenna structure, an example of which is illustrated in FIG. 1.
Figure 3B:
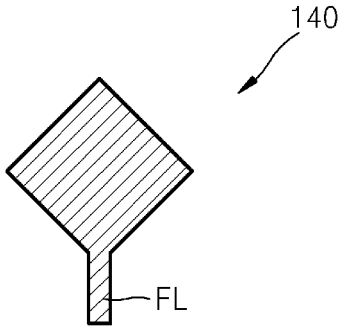
Figure 3C:
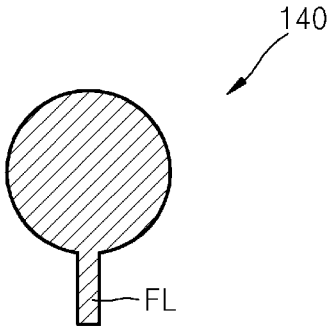

FIGS. 3A, 3B, and 3C illustrate examples of line feeding whereby a signal is directly supplied to the antenna structure 100 of FIG. 1 via the feeding line FL. The shape of the patch antenna unit 140 may be modified in various ways, as well as the rectangular shape, the diamond shape, and the circular shape illustrated in FIGS. 3A, 3B, and 3C, respectively.

Figure 3D:
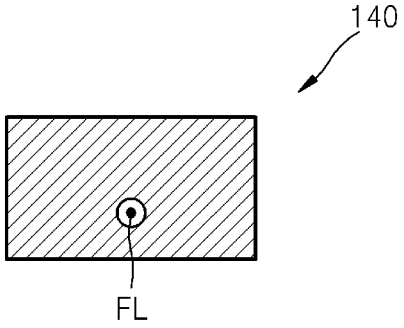
Figure 3E:
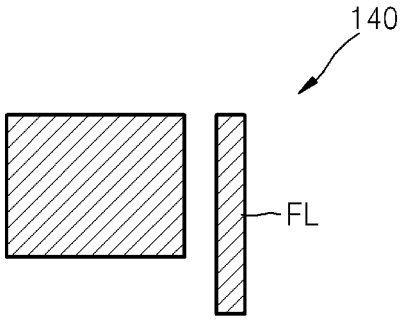
Figure 3F:
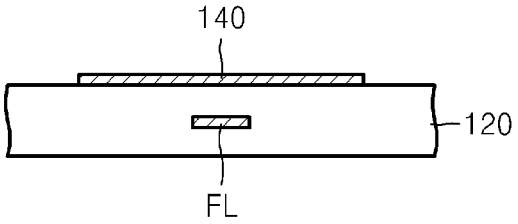
Figure 3G:
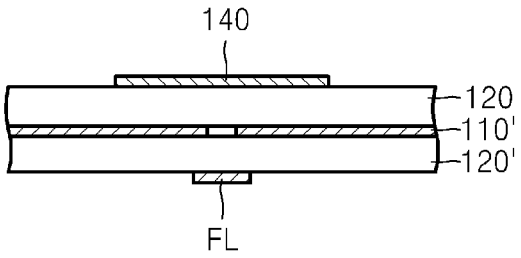

FIG. 3D illustrates a coaxial feeding method, and FIGS. 3E, 3F, and 3G illustrate examples of coupling feeding. As illustrated in FIG. 3E, the feeding line FL may be disposed on the same plane as the patch antenna unit 140, or as illustrated in FIG. 3F, the feeding line FL may be disposed on a different plane from that of the patch antenna unit 140, for example, inside the substrate 120. FIG. 3G illustrates an example of slot coupling in which a ground layer 110' having slots formed therein is formed on a bottom surface of the substrate 120 and the feeding line FL is formed below the ground layer 110'. The feeding line FL may be formed inside a dielectric layer 120' that is disposed under the ground layer 110', or may be formed on a surface of the dielectric layer 120'.

Figure 4:
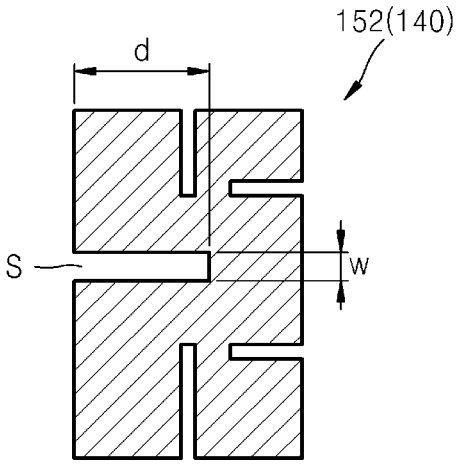
FIGS. 4 and 5 illustrate examples of slit patterns that may be employed in an antenna structure, an example of which is shown in FIG. 1, for frequency tuning.
Figure 5:
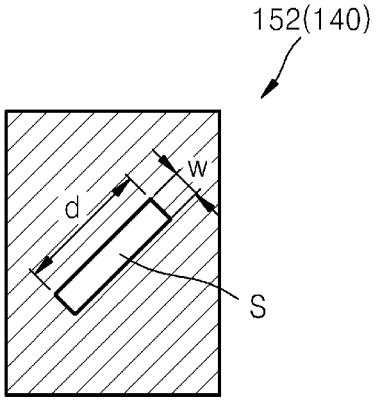

FIGS. 4 and 5 illustrate examples of slit patterns that may be employed in the planar pattern unit 152 or the patch antenna unit 140 of the antenna structure 100 of FIG. 1 for frequency tuning.

Referring to FIG. 4, a slit pattern S has a groove shape that is recessed from a lateral portion of the planar pattern unit 152 or the patch antenna unit 140, and a width w and a length d of the slit pattern S having a groove shape may be adjusted for proper frequency tuning. The positions and number of slit patterns S are not limited to the exemplary embodiments of FIG. 4.

Referring to FIG. 5, a slit pattern S may have an opening shape that is formed through the planar pattern unit 152 or the patch antenna unit 140. A width w and a length d of the slit pattern S having an opening shape may be adjusted for proper frequency tuning. However, the shape of the slit pattern S having an opening shape is not limited to the rectangular shape shown in the exemplary embodiment of FIG. 5.

The slit patterns S illustrated in FIGS. 4 and 5 may be combined to form in the planar pattern unit 152 and the patch antenna unit 140.

Figure 6:
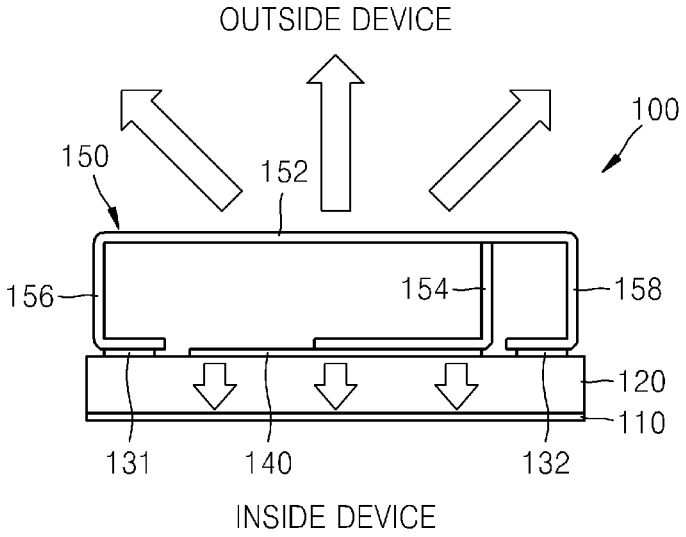
FIG. 6 illustrates a radiation path of a device employing an antenna structure, an example of which is shown in FIG. 1, with a reduced effect of metal that is disposed adjacent to an antenna structure, an example of which is shown in FIG. 1.

FIG. 6 illustrates a radiation path of a device employing the antenna structure 100 of FIG. 1 with a reduced effect of metal that is disposed adjacent to the antenna structure 100 of FIG. 1. Radiation of the antenna structure 100 in a downward direction is reduced due to the ground layer 110 formed in a lower portion of the antenna structure 100, and radiation of the antenna structure 100 in an upward direction is relatively increased. Thus, when the antenna structure 100 is disposed inside an electronic device that requires a wireless communication function, the ground layer 110 of the antenna structure 100 may be disposed adjacent to a metal structure formed inside the electronic device, or may be attached to the metal structure so that radiation efficiency of the antenna structure 100 outside the electronic device may be improved. Radiation efficiency of the antenna structure 100 that is designed in a 2.4 GHz band is approximately 60% when the antenna structure 100 is installed on a WiFi board, and is approximately 52% even when the antenna structure 100 is installed within a camera. Therefore, a reduction in efficiency due to the effect of metal disposed adjacent to the antenna structure 100 is very small.

Figure 7:
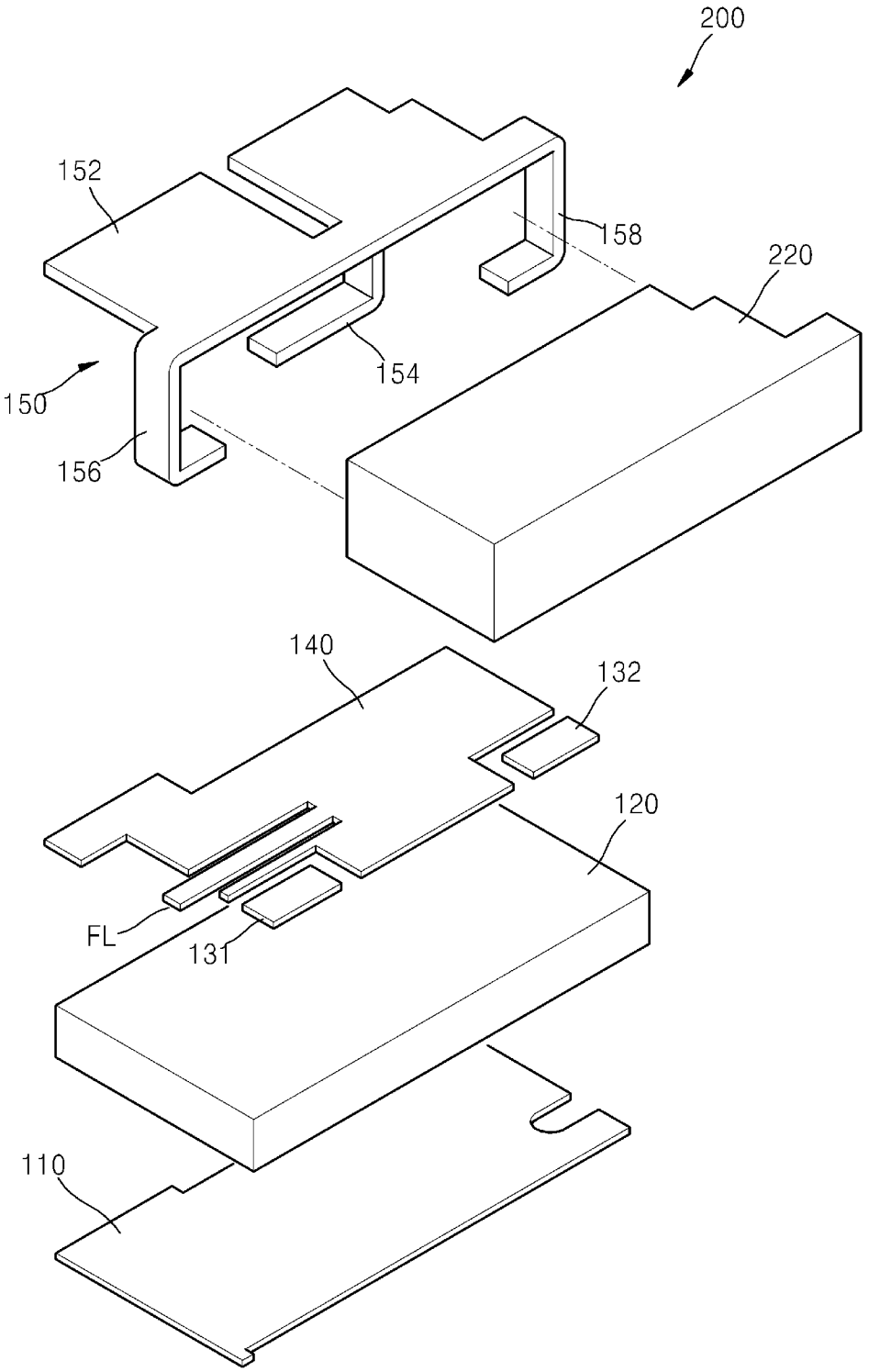
FIG. 7 is a schematic exploded perspective view of an antenna structure according to another exemplary embodiment.

FIG. 7 is a schematic exploded perspective view of an antenna structure 200 according to another exemplary embodiment.

The antenna structure 200 according to the current exemplary embodiment is different from the antenna structure 100 of FIG. 1 in that a dielectric carrier 220 is further disposed between the patch antenna unit 140 and the planar pattern unit 152 of the 3D antenna unit 150.

When the dielectric carrier 220 is disposed, the planar pattern unit 152 may be formed on a top surface of the dielectric carrier 220, and the shorting leg 154 may extend from the top surface of the dielectric carrier 220 to a bottom surface of the dielectric carrier 220 along a side surface of the dielectric carrier 220.

In addition, a radiation unit of the 3D antenna unit 150 includes at least one floating leg that extends from one end of the planar pattern unit 152 in a direction of the patch antenna unit 140, and the at least one floating leg may extend from the top surface of the dielectric carrier 220 along the side surface of the dielectric carrier 220. Although the first floating leg 156 and the second floating leg 158 are shown in FIG. 7, the positions and number thereof are not limited to those shown in the exemplary embodiment of FIG. 7.

The dielectric carrier 220 may be formed of a dielectric material having a relative dielectric constant that is greater than 1. Thus, the overall size of the antenna structure 200 of FIG. 7 may be reduced as compared to that of the antenna structure 100 of FIG. 1 when the same frequency band is used for the respective designs. In addition, since the dielectric carrier 220 also serves to securely install the 3D antenna unit 150 on the substrate 120, the first bonding pad 131 and the second bonding pad 132 that securely install the first floating leg 156 and the second floating leg 158 on the substrate 120, may not be required. In addition, ends of the first floating leg 156 and the second floating leg 158 do not have to be bent in a direction parallel to the substrate 120.

The shape of the dielectric carrier 220 is not limited to the shape shown in the exemplary embodiment of FIG. 7, and the shapes of the shorting leg 154 or the first floating leg 156 and the second floating leg 158 may be modified together according to the shape of the dielectric carrier 220.

As described above, an antenna structure according to the one or more embodiments may have a small structure, and an effect on the antenna structure due to a metal material that is disposed adjacent to the antenna structure is reduced so that radiation efficiency of the antenna structure may be improved.

Thus, when the antenna structure is employed in an electronic device for wireless communication, the antenna structure may be disposed inside the electronic device in which a metal material is disposed adjacent to the antenna structure, or the antenna structure may be attached to a metal structure so that there are minimal limitations in a space for installing the antenna structure.

The foregoing exemplary embodiments are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An antenna structure comprising:

a substrate;

a ground layer disposed on a first surface of the substrate;

a patch antenna unit which is disposed on a second surface of the substrate opposite to the first surface of the substrate, and is configured to receive a signal to be radiated; and a three-dimensional (3D) antenna unit which comprises a shorting leg that is shorted with the patch antenna unit, and is configured to radiate the signal received by the patch antenna unit, wherein the 3D antenna unit further comprises:

a planar pattern unit spaced apart from the patch antenna unit; and at least one floating leg that extends from the planar pattern unit to the patch antenna unit.

2. The antenna structure of claim 1, wherein the shorting leg extends from the planar pattern unit towards the patch antenna unit.

3. The antenna structure of claim 2, wherein the planar pattern unit has at least one slit pattern for frequency tuning.

4. The antenna structure of claim 3, wherein the slit pattern is a groove that is recessed from a lateral portion of the planar pattern unit.

5. The antenna structure of claim 3, wherein the slit pattern is an opening that is formed through the planar pattern unit.

6. The antenna structure of claim 2, wherein the shorting leg comprises:

a protrusion that protrudes from the 3D antenna unit; and a bonding portion that extends from the protrusion in a direction parallel to a top surface of the patch antenna unit.

7. The antenna structure of claim 1, wherein the at least one floating leg is configured to support the planar pattern unit.

8. The antenna structure of claim 1, wherein the at least one floating leg comprises a first floating leg and a second floating leg that are respectively disposed at opposite sides of the shorting leg.

9. The antenna structure of claim 8, wherein the first floating leg and the second floating leg are fixed on the substrate.

10. The antenna structure of claim 9, wherein ends of the first floating leg and the second floating leg are bent in a direction parallel to a plane of the substrate that faces the ground layer.

11. The antenna structure of claim 9, further comprising a first bonding pad and a second bonding pad that are disposed on the substrate, wherein the first floating leg and the second floating leg are bonded to the first bonding pad and the second bonding pad bond, respectively.

12. The antenna structure of claim 2, wherein a dielectric carrier is disposed between the planar pattern unit and the patch antenna unit.

13. The antenna structure of claim 12, wherein the shorting leg extends from a top surface of the dielectric carrier to a bottom surface of the dielectric carrier along a side surface of the dielectric carrier.

14. The antenna structure of claim 12, wherein the 3D antenna unit comprises at least one floating leg that extends from an end of the planar pattern unit along the side surface of the dielectric carrier to the patch antenna unit.

15. The antenna structure of claim 1, wherein the signal to be radiated is supplied to the patch antenna unit by one of a coupling feeding, a line feeding and a coaxial feeding.

16. The antenna structure of claim 1, wherein slit patterns for frequency tuning are formed in the patch antenna unit.

17. The antenna structure of claim 16, wherein the slit pattern is a groove that is recessed from a lateral portion of the planar pattern unit or an opening shape that is formed through the planar pattern unit.

18. The antenna structure of claim 1, wherein the substrate is formed of a FR4 material.

19. The antenna structure of claim 1, further comprising a radio frequency (RF) circuit, and a transmission line which transmits a signal generated by the RF circuit to the patch antenna unit, wherein the RF circuit and the transmission line are embedded in the substrate.

20. An electronic device having a wireless communication function, the electronic device comprising the antenna structure of claim 1.

21. The electronic device of claim 20, wherein the electronic device comprises a metal structure, and the ground layer of the antenna structure is bonded to the metal structure.

* * * * *